US008087478B2

(12) United States Patent
Patel

(10) Patent No.: US 8,087,478 B2
(45) Date of Patent: Jan. 3, 2012

(54) CUTTING ELEMENTS INCLUDING CUTTING TABLES WITH SHAPED FACES CONFIGURED TO PROVIDE CONTINUOUS EFFECTIVE POSITIVE BACK RAKE ANGLES, DRILL BITS SO EQUIPPED AND METHODS OF DRILLING

(75) Inventor: Suresh G. Patel, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/478,806

(22) Filed: Jun. 5, 2009

(65) Prior Publication Data

US 2010/0307829 A1 Dec. 9, 2010

(51) Int. Cl.
*E21B 10/16* (2006.01)
*E21B 10/52* (2006.01)

(52) U.S. Cl. ..... 175/57; 175/430

(58) Field of Classification Search ..... 175/57, 175/430

See application file for complete search history.

(56) References Cited

U.S. PATENT DOCUMENTS

| | | | | | |
|---|---|---|---|---|---|
| 4,538,690 | A | | 9/1985 | Short, Jr. | |
| 4,554,986 | A | | 11/1985 | Jones | |
| 4,558,753 | A | * | 12/1985 | Barr | 175/431 |
| 4,593,777 | A | | 6/1986 | Barr | |
| 4,858,707 | A | | 8/1989 | Jones et al. | |
| 4,872,520 | A | * | 10/1989 | Nelson | 175/430 |
| 4,981,184 | A | | 1/1991 | Knowlton et al. | |
| 5,061,293 | A | | 10/1991 | Barr et al. | |
| 5,078,219 | A | * | 1/1992 | Morrell et al. | 299/111 |
| 5,222,566 | A | * | 6/1993 | Taylor et al. | 175/431 |
| 5,244,039 | A | * | 9/1993 | Newton et al. | 175/431 |
| 5,332,051 | A | | 7/1994 | Knowlton | |
| 5,377,773 | A | | 1/1995 | Tibbitts | |
| 5,460,233 | A | * | 10/1995 | Meany et al. | 175/428 |
| 5,467,836 | A | * | 11/1995 | Grimes et al. | 175/401 |
| 6,000,483 | A | | 12/1999 | Jurewicz et al. | |
| 6,003,623 | A | | 12/1999 | Miess | |
| 6,045,440 | A | | 4/2000 | Johnson et al. | |
| 6,050,354 | A | * | 4/2000 | Pessier et al. | 175/430 |
| 6,065,554 | A | | 5/2000 | Taylor et al. | |

(Continued)

FOREIGN PATENT DOCUMENTS

EP 0841463 5/1998

(Continued)

OTHER PUBLICATIONS

Search Report and Written Opinion for Corresponding PCT matter PCT/US20100/37062, mailed Feb. 7, 2011, 8 pages.

*Primary Examiner* — Jennifer H Gay
(74) *Attorney, Agent, or Firm* — Traskbritt

(57) ABSTRACT

A cutting element for a drag-type earth-boring drill bit includes a cutting table with a face including a region that is configured to cut into a formation at a positive back rake angle and to direct formation cuttings, or chips, that have been cut from the earth formation toward the hydraulics of the drill bit. Drill bits may include one or more cutting elements that have been configured in this manner. Such a drill bit may also include a wear pad for limiting the depth to which a cutting element penetrates a surface of a bore hole in an earth formation. Such a wear pad may have a substantially constant thickness.

14 Claims, 5 Drawing Sheets

U.S. PATENT DOCUMENTS

| | | | | |
|---|---|---|---|---|
| 6,196,340 | B1 | 3/2001 | Jensen et al. | |
| 6,202,770 | B1 | 3/2001 | Jurewicz et al. | |
| 6,405,814 | B1 | 6/2002 | Eyre et al. | |
| 6,408,958 | B1 * | 6/2002 | Isbell et al. | 175/431 |
| 6,550,556 | B2 | 4/2003 | Middlemiss et al. | |
| 6,659,199 | B2 * | 12/2003 | Swadi | 175/57 |
| 6,779,613 | B2 * | 8/2004 | Dykstra et al. | 175/57 |
| 6,883,623 | B2 * | 4/2005 | McCormick et al. | 175/408 |
| 6,904,984 | B1 | 6/2005 | Estes et al. | |
| 7,140,448 | B2 | 11/2006 | Estes et al. | |
| 7,360,608 | B2 * | 4/2008 | Brackin et al. | 175/57 |
| 7,363,992 | B2 * | 4/2008 | Stowe et al. | 175/426 |
| 7,748,475 | B2 * | 7/2010 | McClain et al. | 175/57 |
| 7,757,785 | B2 * | 7/2010 | Zhang et al. | 175/57 |
| 7,762,355 | B2 * | 7/2010 | McClain et al. | 175/57 |
| 2005/0247486 | A1 | 11/2005 | Zhang et al. | |
| 2006/0283640 | A1 | 12/2006 | Estes et al. | |
| 2007/0102198 | A1 | 5/2007 | Oxford et al. | |
| 2007/0102199 | A1 | 5/2007 | Smith et al. | |
| 2007/0102200 | A1 | 5/2007 | Choe et al. | |
| 2007/0102202 | A1 | 5/2007 | Choe et al. | |
| 2007/0235230 | A1 | 10/2007 | Cuillier et al. | |
| 2008/0006448 | A1 | 1/2008 | Zhang et al. | |
| 2008/0264696 | A1 * | 10/2008 | Dourfaye et al. | 175/428 |
| 2010/0084198 | A1 * | 4/2010 | Durairajan et al. | 175/430 |
| 2010/0307829 | A1 * | 12/2010 | Patel | 175/57 |

FOREIGN PATENT DOCUMENTS

| | | | |
|---|---|---|---|
| EP | 0841463 | B1 | 3/2004 |

* cited by examiner

CUTTING ELEMENTS INCLUDING CUTTING TABLES WITH SHAPED FACES CONFIGURED TO PROVIDE CONTINUOUS EFFECTIVE POSITIVE BACK RAKE ANGLES, DRILL BITS SO EQUIPPED AND METHODS OF DRILLING

TECHNICAL FIELD

The present invention, in various embodiments, relates generally to cutting elements for drag-type earth-boring drill bits and, more specifically, to cutting elements that are configured cut into a subterranean formation at an effective positive back rake angle and to direct formation cuttings, or chips, that have been cut from the earth formation toward the hydraulic flows of the drill bit. The present invention also relates to drill bits including such cutting elements, as well as to methods for drilling into a formation.

RELATED ART

Drag-type earth-boring drill bits typically carry a number of fixed cutting elements, or cutters, each comprising a polycrystalline diamond compact (PDC) cutting table carried on a supporting substrate, conventionally of cemented tungsten carbide. As such a drill bit is rotated and driven into and through an earth formation, the cutting elements follow a helical path, along which they cut into and remove material from the earth formation. Typically, the cutting faces of cutting elements of a conventional drag-type earth-boring drill bit are oriented at negative rake angles, at which the cutting faces form acute angles with tangents to the bore hole being drilled.

While the orientation of cutting elements at negative back rake angles has long been used and has proven to be an effective technique for drilling bore holes, there are a number of undesirable effects when conventionally configured cutting elements with cutting tables that include planar faces are used. For example, cuttings from the earth formation are compressed against the cutting faces of the cutting elements. The continuous presence of cuttings against the cutting face of the PDC cutting table of a cutting element may inhibit cooling of the PDC cutting table, which may cause an undesirably high likelihood that the cutting elements will fracture, break off of the cutting elements, or otherwise fail. In addition, the collection of cuttings against the cutting elements of a rotating drill bit may increase the difficulty of rotating the bit and require excessive weight on-bit (WOB) to force it further against the formation to drill ahead. The negative rake angles at which the cutting faces of the PDC cutting tables are oriented and the consequent manner in which the PDC cutting tables remove material from an earth formation also contribute to the amount of torque that must be applied to the drill string to rotate the bit at an effective rate and the amount of WOB that must be applied to provide a desirable rate of penetration into the earth formation.

Some efforts have been made to orient faces of cutting elements at less negative, even positive, rake angles. When conventionally configured cutting elements, with cutting tables that have substantially planar faces, are oriented at aggressive rake angles, the bit body that carries the cutting elements and/or the studs or posts of such cutting elements may not provide adequate physical support to the cutting tables. This lack of physical support introduces its own complications, including undesirably high failure rates.

SUMMARY

In one embodiment, the present invention includes cutting elements for drag-type earth-boring drill bits. A cutting element of the present invention includes a cutting table with a face that includes a cutting region configured to be oriented at a more aggressive rake angle than would otherwise be dictated by the configuration of a substrate of the cutting element, or by an orientation of the substrate relative to a blade of a drill bit. Due to an orientation of a cutting point along an edge of the face of the cutting table, the cutting point is in compression during drilling, reducing or eliminating damage to the cutting point and, thus, to the cutting table as the cutting element is used to cut into a formation. The face of the cutting table may also include a debris ejection portion configured to direct formation cuttings, or chips, and other debris away from a face of a drill bit by which the cutting element is carried and, optionally, into the hydraulic flows of the drill bit. In some embodiments, the face of the cutting table may further include a chip breaker portion configured to break chips immediately after they have been cut from a formation.

A specific embodiment of a cutting element of the present invention includes a cutting table with a cutting portion of its face oriented at a substantially constant angle relative to a plane taken transverse to a longitudinal axis of the cutting element. In more specific embodiments, the cutting portion of the face of a cutting table may be substantially planar, or it may comprise a section of a tapered recess, or indentation, in the face of the cutting table.

In another embodiment, the present invention includes rotary-type earth-boring drill bits with one or more cutting elements having an effective positive back rake angle. Such a cutting element may be employed as a primary cutter positioned adjacent to the leading edge of a blade of the rotary-type earth-boring drill bit, as a so-called "backup cutter" positioned on the same blade as and rotationally behind a corresponding primary cutter, or a drill bit may include a combination of primary and backup cutting elements with effective positive back rake angles. In some embodiments, a rotary-type earth-boring drill bit may also include wear pads that limit the depth-of-cut (DOC) of each cutting element that has an effective positive back rake. The wear pads may be configured to wear at substantially the same rate as the cutting portion of their corresponding cutting elements. Some embodiments of wear pads have uniform thicknesses; i.e., they protrude the same distance from a blade of a bit body at substantially all locations across their wear surfaces.

The present invention also includes embodiments of methods for drilling formations. In such methods, one or more cutting elements that include cutting regions that are oriented at positive rake angles are used to cut material from a formation. The material that is removed from the formation, in the form of chips or other debris, may be removed without exerting significant compressive forces on the formation. The chips or other debris may be broken into smaller pieces as they impact another portion of the faces of the cutting elements. The cutting elements may also prevent the chips or other debris from collecting on a face of the drill bit, and instead direct the chips or other debris into the drill bit's hydraulic flows, which may carry the chips or other debris away from the drill bit.

Other embodiments, as well as the features and advantages of various embodiments of the present invention, will become apparent to those of ordinary skill in the art through consideration of the ensuing description, the accompanying drawings, and the appended claims.

DETAILED DESCRIPTION

Figure 1:
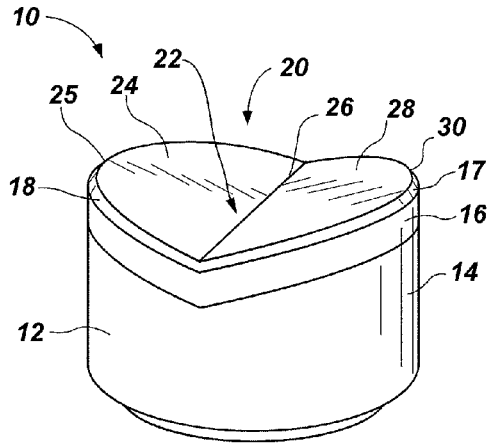
FIGS. 1 through 8 depict various embodiments of cutting elements of the present invention.

FIGS. 1 through 4 illustrate embodiments of cutting elements 10, 10' according to the present invention. Each cutting element 10, 10' includes a substrate 12, 12' and a cutting table 16, 16' at an end 14, 14' of substrate 12, 12'.

Figure 2:
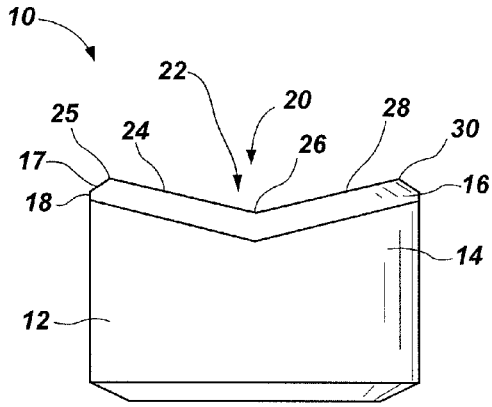

As depicted in FIGS. 1 and 2, some embodiments of a cutting element 10 include a cutting table 16 that has been secured to end 14 of substrate 12. In such embodiments, cutting table 16 may comprise superabrasive material, as in a polycrystalline diamond compact (PDC), or a softer but still superabrasive material, such as cubic boron nitride (CBN) or a thermally stable polycrystalline diamond (TSP).

Figure 3:
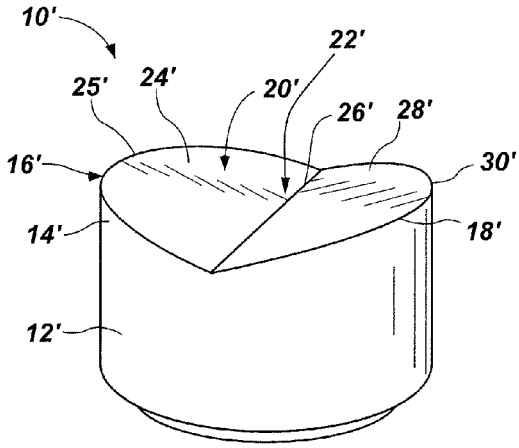
Figure 4:
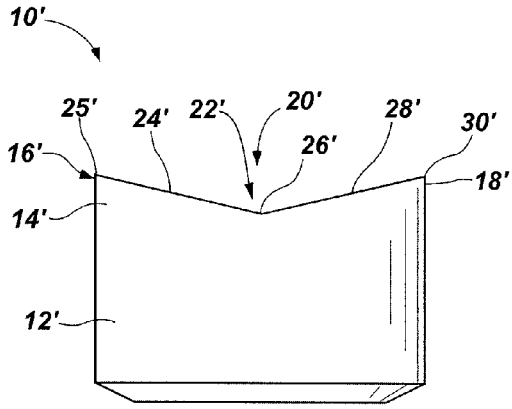

Another embodiment of cutting element 10' according to the present invention is shown in FIGS. 3 and 4. A cutting table 16' of cutting element 10' is formed from an end 14' of substrate 12', rather than being secured to end 14'. In such an embodiment, cutting table 16' may have the same or substantially the same composition as substrate 12'. Alternatively, the material of substrate 12' may be modified (e.g., impregnated with one or more other materials, densified, etc.) at cutting table 16' to impart cutting table 16' with one or more desired characteristics.

With collective reference to FIGS. 1 through 4, cutting table 16, 16' may include a face 20, 20' with a cutting portion 24, 24' and a debris ejection portion 28, 28'.

Cutting portion 24, 24' includes a cutting point 25, 25' at or adjacent to a peripheral edge 18, 18' of cutting table 16, 16' and tapers inwardly from cutting point 25, 25' toward a center 22, 22' of face 20, 20'. The taper of cutting portion 24, 24' is configured to impart cutting element 10, 10' with a desired effective positive back rake angle. Cutting portion 24, 24' may taper at a constant angle relative to a plane taken transverse to an axis through the length of substrate 12, 12'. As a cutting table 16, 16' that has a cutting portion 24, 24' with a constant taper wears, the effective positive back rake angle at cutting point 25, 25' will remain substantially the same. In the illustrated embodiments, cutting portion 24, 24' comprises a planar or substantially planar portion of face 20, 20' that tapers inwardly to a boundary 26, 26' with debris ejection portion 28, 28'. In some embodiments, boundary 26, 26' may be located at an approximate diameter of face 20, 20'.

Debris ejection portion 28, 28' tapers outwardly from a central location on face 20, 20' (e.g., from boundary 26, 26', etc.) to a location 30, 30' at or near an opposite side of periphery 18, 18' from cutting point 25, 25'. In some embodiments, cutting point 25, 25' and location 30, 30' may be diametrically opposed. Debris ejection portion 28, 28' is configured and oriented to direct debris to a desired location relative to cutting table 16, 16'. Debris ejection portion 28, 28' may also be configured and oriented as a so-called "chip breaker" to break formation cuttings, or chips, cut from the formation being drilled into smaller pieces as that debris encounters or impacts debris ejection portion 28, 28'. In some embodiments, the taper of debris ejection portion 28, 28' may be constant or substantially constant. In more specific embodiments, debris ejection portion 28, 28' may comprise a planar or substantially planar portion of face 20, 20'.

Figure 5:
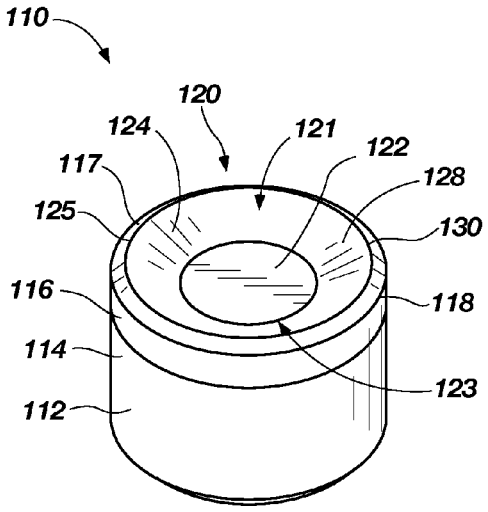
Figure 6:
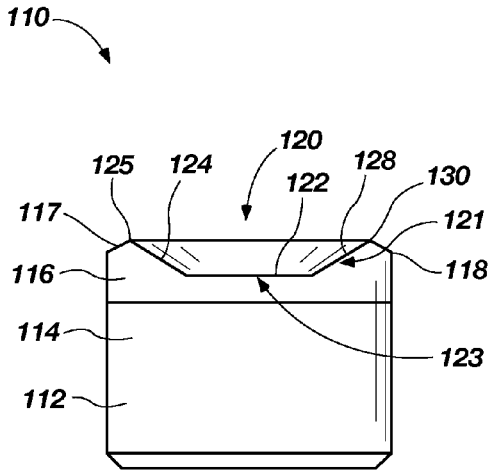
Figure 7:
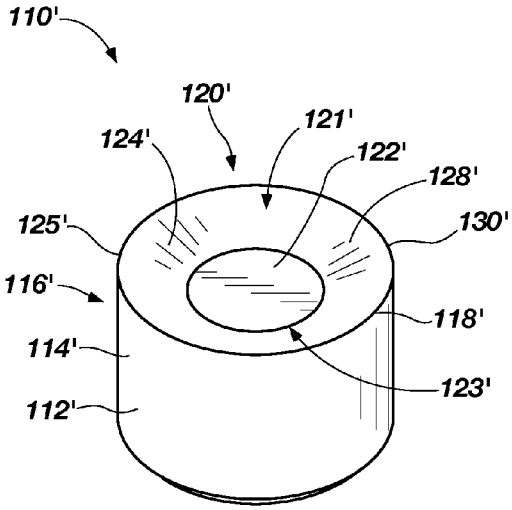
Figure 8:
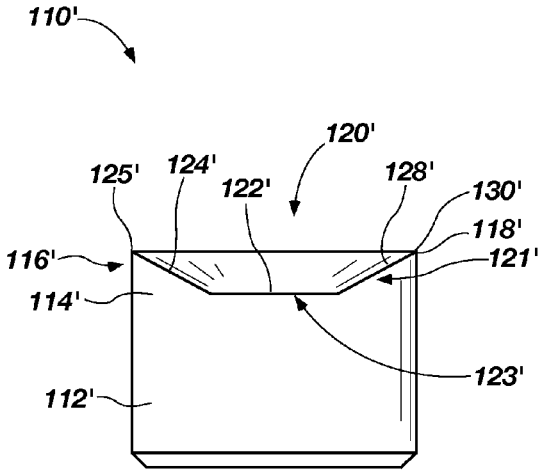

Cutting elements 110, 110' that include cutting tables 116, 116' with another configuration of face 120, 120' are shown in FIGS. 5 through 8. In FIGS. 5 and 6, an embodiment of a cutting element 110 with a cutting table 116 that is adhered to an end 114 of a substrate 112 is depicted, like that described above in reference to FIGS. 1 and 2. Cutting element 110' of FIGS. 7 and 8 includes a cutting table 116' that comprises an end 114' of a substrate 112'.

Each cutting table 116, 116' includes a face 120, 120' with an indentation 121, 121', or recess, that tapers inwardly from at least a portion of an outer periphery 118, 118' of face 120, 120' toward a central region 122, 122' of face 120, 120'.

At one location, an area of the taper of indentation 121, 121' comprises a cutting portion 124, 124', which extends from a cutting point 125, 125' of outer periphery 118, 118' of face 120, 120' toward central region 122, 122'. The taper of cutting portion 124, 124' is configured to impart cutting element 110, 110' with a desired effective positive back rake angle. Cutting portion 124, 124' may taper at a constant angle relative to a plane taken transverse to an axis through the length of substrate 112, 112'. As a cutting table 116, 116' that has a cutting portion 124, 124' with a constant taper wears, the effective positive back rake angle at cutting point 125, 125' will remain substantially the same.

At another location, the taper of indentation 121, 121' forms a debris ejection portion 128, 128', which extends from central region 122, 122' to an ejection location 130, 130' on outer periphery 118, 118' of face 120, 120'. In some embodiments, debris ejection portion 128, 128' may taper at a constant angle. In other embodiments, the taper of debris ejection portion 128, 128' may be curved. Debris ejection portion 128, 128' is located, oriented, and configured to direct debris in a predetermined direction from face 120, 120', as well as from the remainder of cutting element 110, 110'. In the depicted embodiment, cutting portion 124, 124' and debris ejection portion 128, 128' are on opposite sides of face 120, 120' from each other. In some embodiments, ejection location 130, 130' is diametrically opposite from cutting point 125, 125'.

Some embodiments of face 120, 120', such as those illustrated in FIGS. 5 through 8, include central regions 122, 122' that comprise chip breaker regions 123, 123'. A chip breaker region 123, 123' may, in some embodiments, be oriented substantially parallel to a plane taken transverse to an axis that extends through the length, or height, or cutting element 110, 110'. In some embodiments, such as those depicted, chip breaker regions 123, 123' are flat, or substantially planar, portions of face 120, 120'. In a specific embodiment, indentation 121, 121' may have a frustoconical shape, as illustrated, a similar shape (e.g., a shape with an oblong base, etc.), or the shape of a truncated pyramid.

In some embodiments, cutting tables 16, 116 (FIGS. 1, 2, 5, and 6) include edge chamfers 17, 117. The size of an edge chamfer 17, 117 may be tailored to enhance the durability of cutting table 16, 116 and the cutting element 10, 110 of which it is a part until the cutting element experiences some wear. The cutting tables 16', 116' (FIGS. 3, 4, 7, and 8) of other embodiments of cutting elements 10', 110' of the present invention may lack edge chamfers, as the effective positive rake angles at which faces 20', 120' of cutting tables 16', 116' are oriented may provide them with improved durability over the cutting tables of conventionally configured cutting tables.

Although FIGS. 1 through 4 depict round cutting elements 10, 10', 110, 110', cutting elements of other configurations, including, but not limited to, so-called "shaped" cutting elements are also within the scope of the present invention. In a specific embodiment, an elliptical cutting element with a shaped face 20, 20', 120, 120' may be used to form long, thin formation cuttings.

As a bit body that carries a cutting element 110, 110' rotates, chips that have just been cut from an earth formation impact chip breaker region 123, 123', where the chips may be broken up into smaller pieces. The debris may then be carried from chip breaker region 123, 123' over debris ejection portion 128, 128', which directs the debris away from face 120, 120' and, thus, from cutting element 110, 110'.

A variety of techniques may be used to fabricate an embodiment of a cutting element 10, 10', 110, 110' of the present invention. Known techniques may be used to shape an end 14, 14', 114, 114' of a substrate 12, 12', 112, 112' in a desired configuration. In some embodiments, end 14, 14', 114, 114' may have a conventional configuration, as used in the manufacture of cutting elements that include cutting tables with substantially planar faces. In other embodiments, end 14, 14', 114, 114' may be configured to have a similar shape to, or substantially the same shape as, the intended shape for face 20, 20', 120, 120' of cutting table 16, 16', 116, 116'.

Figure 9:
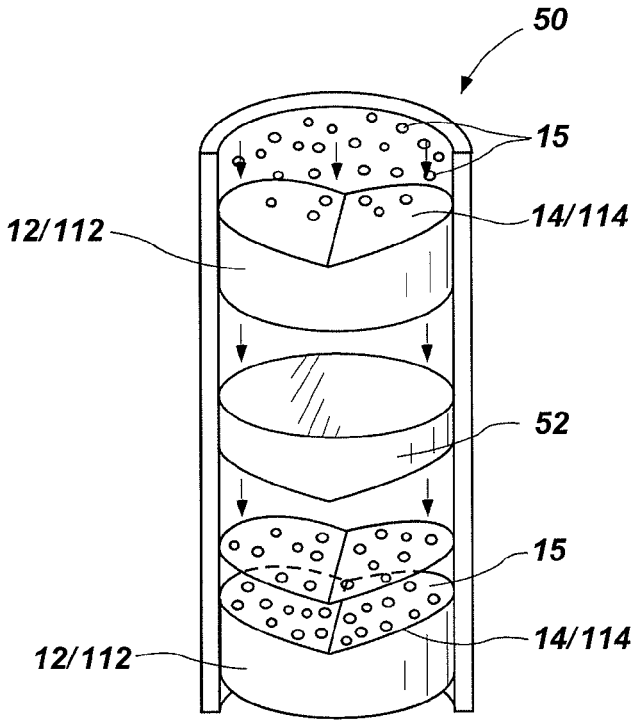
FIG. 9 schematically illustrates an embodiment of a process for fabricating a cutting element of the present invention.

When any of such embodiments are employed to fabricate substrates 12, 112 (FIGS. 1, 2, 5, and 6) with ends 14, 114 upon which cutting tables 16, 116 are to be formed, one or more substrates 12, 112 (with or without pre-shaped ends 14, 114) may be introduced into a conventional synthesis cell assembly 50, as illustrated by FIG. 9. A suitable cutting table material 15 (e.g., diamond grit, etc.) and a suitable binder material, such as cobalt, another Group VIII metal, such as nickel, iron, or alloys including these materials (e.g., Ni/Co, Co/Mn, Co/Ti, Co/Ni/V, Co/Ni, Fe/Co, Fe/Mn, Fe/Ni, Fe (NiCr), Fe/$Si_2$, Ni/Mn, Ni/Cr, etc.), is also introduced into synthesis cell assembly 50, adjacent to the end 14, 114 of substrate 12, 112 adjacent to which a cutting table 16, 116 (FIGS. 1, 2, 5, and 6) is to be fabricated. Inserts 52 of synthesis cell assembly 50 that are configured to impart a face 20, 120 (FIGS. 1, 2, 5, and 6) of each cutting table 16, 116 with a desired shape are positioned on an opposite side of the cutting table material 15 from end 14, 114 of the corresponding substrate 12, 112. In embodiments where an insert 52 has a shape that is similar to, or substantially the same as, the shape of end 14, 114 of substrate 12, 112, the insert 52 may be aligned with end 14, 114 in such a way that the corresponding shapes of these elements are also aligned. The contents of synthesis cell assembly 50 may then be subjected to high temperature, high pressure (HTHP) processing, in known fashion, to form a cutting table 16, 116 atop end 14, 114 of each substrate 12, 112 and to adhere each cutting table 16, 116 to the end 14, 114 of its respective substrate 12, 112.

In the illustrated embodiment of FIG. 9, substrate 12, 112 comprises a conventional stud (e.g., an elongate cylinder or an elongate prism). In other embodiments, substrate 12, 112 may comprise a relatively thin element that may then be secured to another support, such as the angled head of a post, or shaped cutter.

Other embodiments include the fabrication of a cutting table 16, 116 (FIGS. 1, 2, 5, and 6) by conventional techniques to impart cutting table 16, 116 with a substantially planar face 20, 120, followed by the removal of material from face 20, 120 to shape the same. In some embodiments, a face 20, 20', 120, 120' of a cutting table 16, 16', 116, 116' (FIGS. 1 through 8) may be shaped by electrical discharge machining (EDM) or any other suitable subtractive process.

In still other embodiments, other processes may be employed, such as the use of EDM to remove material from a conventionally configured cutting table to impart the same with a desired face shape, or by any other suitable fabrication process.

Cutting table 16, 116 may be formed as a single element, or it may include a plurality of separate layers or pieces. In some such embodiments, a cutting table 16, 116 may include a series of laminated layers. In such an embodiment, if one layer fails (e.g., is cracked or broken), lamination may restrain the failure from spreading to adjacent layers or other layers of cutting table 16, 116. In another embodiment, an outer annular element (e.g., a raised portion) of a cutting table 16, 116 may be formed separately from and subsequently assembled with an inner or central element (e.g., a recessed portion) of cutting table 16, 116. In yet another embodiment, separate halves (e.g., a cutting side and a debris removal side) of a cutting table 16 may be formed separately from and subsequently assembled with each other.

Figure 10:
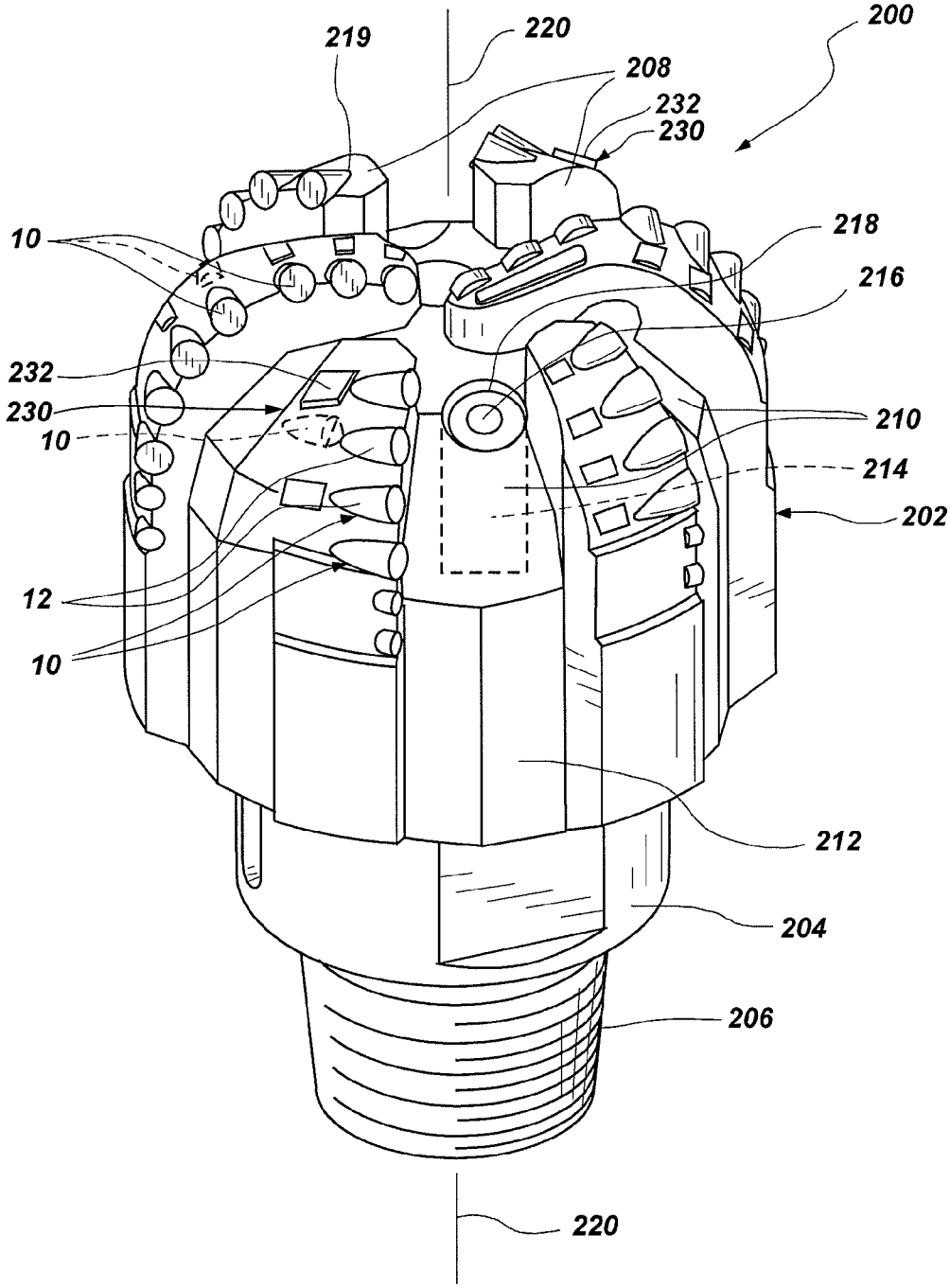
FIG. 10 depicts an embodiment of an earth-boring drag bit carrying one or more cutting elements of the present invention.

Turning now to FIG. 10, an embodiment of a rotary-type earth-boring drill bit 200 according to the present invention is depicted. In the illustrated embodiment, drill bit 200 is a rotary drag bit that includes a mass of particulate material (e.g., a metal powder, such as tungsten carbide) infiltrated with a molten, subsequently hardenable binder (e.g., a copper-based alloy). It should be understood, however, that the present invention is not limited to conventional matrix-type bits, and that bits with bodies of other manufacture, including, but not limited to, steel body bits and bits with bodies that have been manufactured from new particle-matrix composite materials, may also be configured according to the present invention. New particle-matrix composite materials have higher melting points than the materials from which conventional matrix-type bits are fabricated and may include materials such as nickel-based alloys, cobalt-based alloys, cobalt- and nickel-based alloys, aluminum-based alloys, and titanium-based alloys. In addition to conventional matrix infiltration processes, known powder compaction and sintering techniques may be used to fabricate bit bodies that comprise new particle-matrix composite materials. Examples of such new particle-matrix composite materials and of techniques for manufacturing bit bodies from such materials are disclosed in U.S. patent application Ser. No. 11/272,439, filed Nov. 10, 2005, now U.S. Pat. No. 7,776,256, issued Aug. 17, 2010, U.S. patent application Ser. No. 11/271,153, filed Nov. 10, 2005, now U.S. Pat. No. 7,802,495, issued Sep. 28, 2010, U.S. patent application Ser. No. 11/540,912, filed Sep. 29, 2006, now U.S. Pat. No. 7,913,779, issued Mar. 29, 2010, and U.S. patent application Ser. No. 11/593,437, filed Nov. 6, 2006, now U.S. Pat. No. 7,784,567, issued Aug. 31, 2010, the entire disclosure of each of which is, by this reference, hereby incorporated herein.

Drill bit 200, as shown, includes a variety of external and internal components, such as bit body 202 that may be secured to a blank (not shown), which is in turn secured to a tubular bit shank 204 with a pin connection 206, which may comprise standard American Petroleum Institute (API) threading, at the free end thereof. Bit body 202 includes blades 208 (six in the depicted embodiment) that are separated from one another by generally radially extending fluid courses 210 and junk slots 212 at the outer periphery, or gage, of bit body 202, to which fluid courses 210 lead. Blades 208, fluid courses 210, and their topographical details collectively define the "bit face," which comprises the surface of a drill bit 200 that contacts an undrilled earth formation at the bottom of a bore hole. The exterior shape of a diametrical cross-section of the bit body 202 taken along a longitudinal axis 220 of bit body 202 defines the face, crown profile, or bit profile of drill bit 200. An interior passage through bit shank 204 communicates with internal fluid passages 214 within bit body 202, which, in turn, lead to nozzles 216 in nozzle orifices 218 that open to fluid courses 210.

Figure 12:
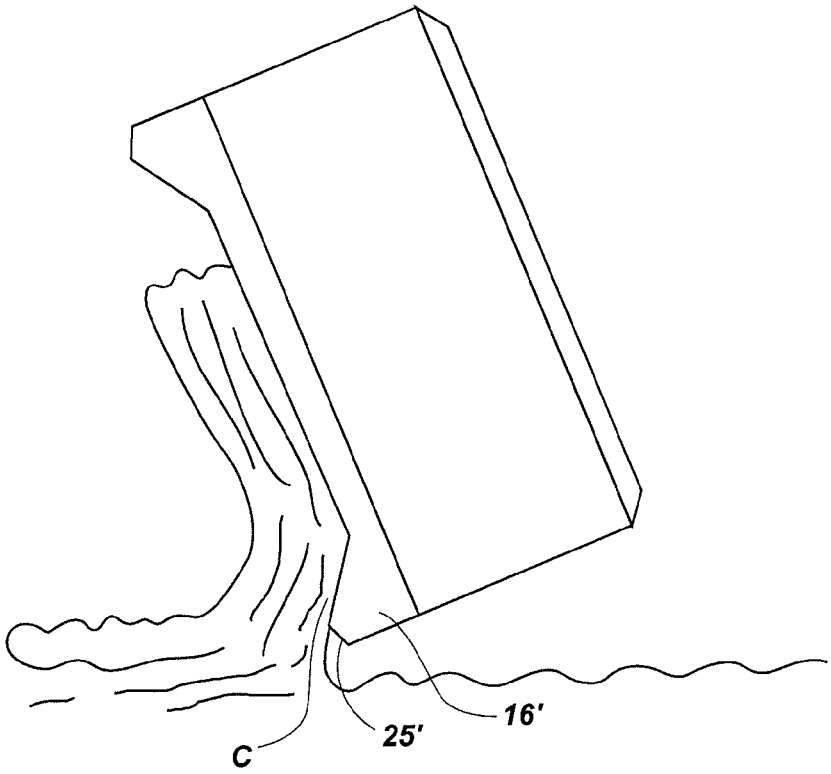
FIG. 12 shows an embodiment of a manner in which a cutting element of the present invention may support a formation cutting as the formation cutting is formed.
Figure 13:
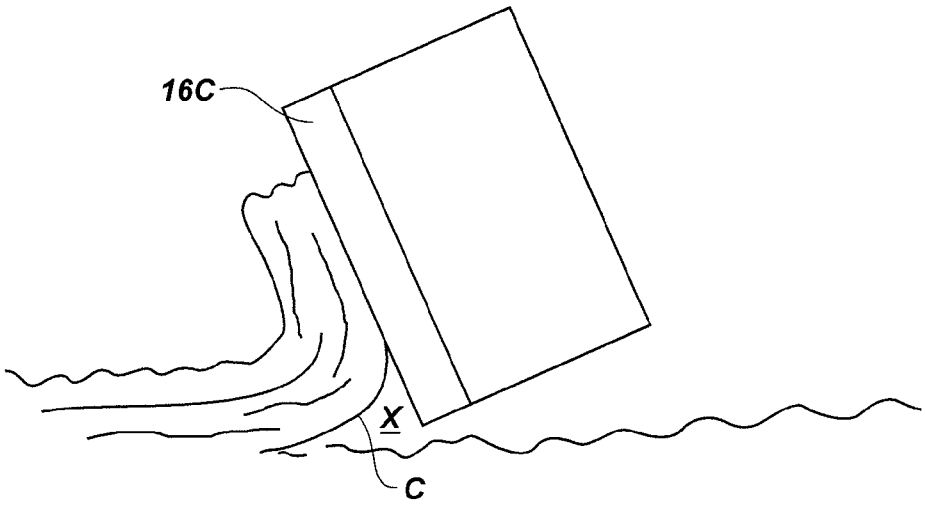
FIG. 13 (Prior Art)
FIG. 13 illustrates a lack of support provided to a formation cutting by a conventional cutting element that has been oriented at a negative back rake angle.

In various embodiments, a plurality of cutting elements according to one or more embodiments of the present invention (e.g., cutting elements 10, as depicted, or other embodiments of cutting elements, such as cutting elements 10', 110, 110' (FIGS. 3 through 8), etc.) may be carried by each blade 208 of bit body 202. All of the cutting elements of a drill bit 200 may comprise an embodiment of cutting element 10 of the present invention (or, of course, any other embodiment of cutting element 10', 110, 110', etc., of the present invention), or embodiments of cutting elements according to teachings of the present invention may be used in conjunction with other configurations of cutting elements (e.g., conventionally configured cutters that include PDC, CBN, or TSP cutting tables with planar faces, etc.). Each cutting element 10 of drill bit 200 may be held within a pocket 219 of a blade 208 in a manner known in the art, such as by brazing. The orientations of pockets 219 and the substrates 12 of the cutting elements 10 therein may, in some embodiments, be substantially the same as pocket and cutting element orientations that would impart conventionally configured cutting elements with negative back rake angles. Regardless of the conventional orientation of the substrate 12 of each cutting element 10, a cutting portion 24 (FIGS. 1 and 2) of its face 20 is effectively oriented at a positive back rake angle, enabling a cutting point 25 of outer periphery 18 of face 20 of the cutting table 16 of each cutting element 10 to slice into an earth formation without substantially compressing the earth formation, but while exerting sufficient compressive force upon cutting point 25 to prevent damage to cutting table 16. With a more positive back rake, cutting point 25' of a cutting table of the present invention (e.g., cutting table 16' in the depicted embodiment, etc.) will be buried beneath and, thus, support an evolving cutting formation C, as shown in FIG. 12. In contrast, a cutting element 16C that is oriented at a more negative rake angle would not provide the same support for an evolving cutting formation C (i.e., there would be space X beneath the evolving cutting formation C), as shown in FIG. 13.

Cutting elements 10, along with any differently (e.g., conventionally) configured cutting elements, of drill bit 200 may be arranged in any suitable manner known in the art. Some embodiments of drill bit 200 include cutting elements (including cutting elements 10 of the present invention) that may be arranged to cut a series of immediately adjacent, communicating grooves into an earth formation. Drill bits 200 in which one or more cone cutters, which are subjected to high loads but small surface speeds, may comprise a cutting element 10 of the present invention. In other embodiments, the cutting elements of drill bit 200 may be arranged in so-called "kerfing" configurations (which are useful in cutting so-called "ultrahard" earth formations), by which spaced apart grooves are cut into an earth formation (e.g., by conventionally configured cutting elements or by a cutting element 10 according to an embodiment of the present invention), then material between the spaced apart grooves is removed with a kerfing cutter, which may comprise a cutting element 10 of the present invention. In some embodiments, a cutting element 10 may be a so-called "backup cutter" positioned rotationally behind another, corresponding primary cutter 10 of the same or different (e.g., conventional, etc.) configuration located on either the same blade 208 or a different blade 208. Regardless of the arrangement of cutters in a particular embodiment of drill bit 200, a cutting element 10 of the present invention may be employed as either a primary cutter or a backup cutter.

Some embodiments of drill bits 200 according to the present invention also include wear pads 230 that protrude from each blade 208. Each wear pad 230 includes a bearing surface 232 that is configured to contact a surface of a bore hole that is formed as drill bit 200 is rotated and drills into an earth formation. Each wear pad 230 may be configured and positioned upon blade 208 to limit the depth-of-cut (DOC) of one or more corresponding cutting elements 10, which may or may not be located on the same blade 208 as that wear pad 230.

In some embodiments, each wear pad 230 may have a substantially uniform thickness. Stated another way, all of the locations across bearing surface 232 of wear pad 230 may protrude substantially the same distance from a surface of the blade 208 by which wear pad 230 is carried. Some embodiments of wear pads 230 have substantially planar surfaces. As drill bit 200 is used, various embodiments of wear pads 230 may be configured to wear substantially evenly across bearing surface 232. In some embodiments, the wear rate of such wear pads 230 and, thus, the material from which such wear pads 230 are formed, may correspond to the rate at which material is worn from a corresponding cutting element 10.

The sizes, configurations, and placements of wear pads 230 may be tailored to impart an embodiment of a drill bit 200 of the present invention with a certain functionality. In some embodiments, wear pads 230 may be configured to impart a drill bit 200 with a certain "feel." Some embodiments of wear pads 230 may be configured to prevent cutting elements 10 from digging into a formation, which may cause reactive torque, which may, in turn, stall or damage drill bit 200. Thus, wear pads 230 may be configured and/or arranged to impart stability to a drill bit 200 of the present invention when drill bit 200 is used under a fairly high (e.g., conventional, etc.) WOB.

Wear pads 230 may be formed on or assembled with their corresponding blades 208 in any suitable manner known in the art. In some embodiments, wear pads 230 may be formed concurrently with the formation of bit body 202. In other embodiments, wear pads 230 may be manufactured separately from bit body 202, then assembled therewith and secured thereto (e.g., in a manner similar to the assembly and securing of cutting elements 10 to bit body 202).

Figure 11:
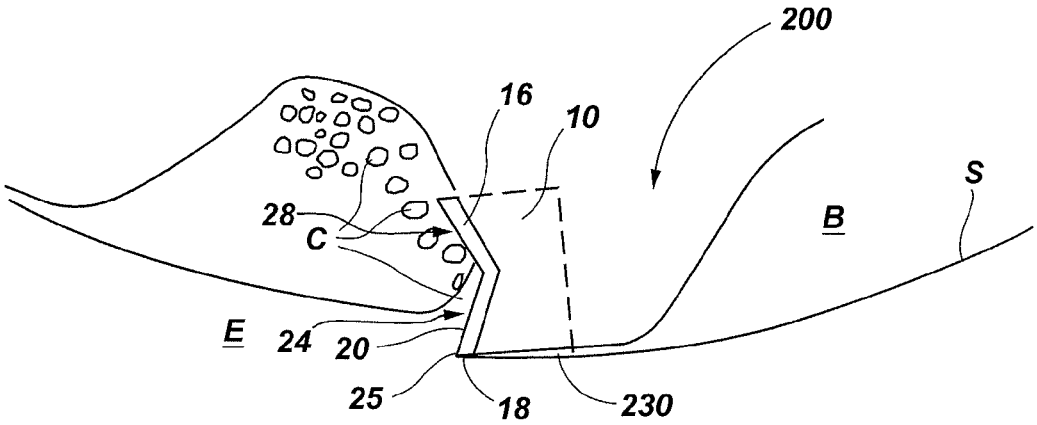
FIG. 11 illustrates an orientation of an embodiment of a cutting element of the present invention while removing material from an earth formation.

As depicted by FIG. 11, when an embodiment of a drill bit 200 of the present invention is used to drill a bore hole B into an earth formation E, rotation of drill bit 200, in conjunction with the effective positive back rake angle of a cutting point 25 on outer periphery 18 of face 20 of cutting table 16 of each cutting element 10 applies tensile force to a surface of the earth formation E to shear material, in the form of formation cuttings C, or chips, therefrom.

By orienting cutting point 25 in a manner that compresses cutting portion 24 during drilling, the likelihood that cutting table 16 will be damaged is also reduced. Accordingly, the need for so-called "redundant" or "backup" cutters may be reduced, and the total number of cutting elements on an embodiment of a drill bit 200 of the present invention may be reduced along with the total cost of the drill bit 200.

One or more wear pads 230 may be positioned at locations that limit the distance each cutting element 10 penetrates the earth formation E, or the DOC of each cutting element 10. By contacting a surface S of the bore hole B as drill bit 200 rotates, wear pads 230 may also prevent cutting elements 10 from biting too far into the surface S—of the bore hole B and the consequent over-torquing of drill bit 200 that may result from cutting elements 10 biting too far into the surface S of the bore hole B.

As drill bit 200 continues to rotate, the formation cuttings C impact face 20 of cutting table 16, which causes the formation cuttings C to break into smaller pieces. Due to the effective positive rake angle at which cutting portion 24 of cutting element 10 is oriented, formation cuttings C may be formed without being compressed and may, therefore, be weaker and easier to break down than formation cuttings formed by conventionally configured and conventionally oriented cutting elements. The formation cuttings C and any other debris may then be directed off of face 20 by a debris ejection portion 28 of face 20. Debris ejection portion 28 may direct the formation cuttings C and other debris away from cutting element 10. Some embodiments of cutting elements 10 include faces 20 that are shaped to cause formation cuttings C to curl.

In some embodiments, the curling of formation cuttings C and/or debris ejection portion 28 of face 20 of a cutting element 10 may divert formation cuttings C from the bit body 202, against which they may otherwise compress and impede the drilling performance of drill bit 200, and direct the formation cuttings C and other debris into a fluid course 210 that is located in front of blade 208 as drill bit 200 rotates. This is particularly useful when the cutting element 10 serves as a backup cutter, which would otherwise be more difficult to clean than a primary cutter because of its position behind the primary cutter.

Drilling fluid, or "mud," may be introduced into the bore hole B to cool drill bit 200. With reference to FIG. 10, drilling fluid is transported through the drill string, (not shown), into bit shank 204, through fluid passages 214, and out of nozzles 216. Drilling fluid and debris then enter fluid courses 210, pass through drill bit 200 through junk slots 212, and up the bore hole. With returned reference to FIG. 11, as the drilling fluid moves generally radially outward through fluid courses 210, it may carry formation cuttings C and any other debris that is directed into fluid courses 210 away from the face of bit body 202, upward through junk slots 212 (FIG. 10) to an annulus between the drill string from which drill bit 200 is suspended, and on up to the surface, out of the bore hole B.

With cutting portions 24 of faces 20 of cutting tables 16 of one or more cutting elements 10 oriented at positive back rake angles, the cutting tables 16 of cutting elements 10 are subject to reduced cutting element loads while removing a given amount of material from an earth formation. As faces 20 of cutting tables 16 may also be configured to improve the flow of formation cuttings away from cutting elements 10, the friction to which cutting tables 16 are subject may also be reduced. As a result of the reduced loads and friction and, possibly, as a byproduct of reduced collection of formation cuttings on or adjacent to cutting elements 10, cutting tables 16 may be heated to lower temperatures than the cutting tables of conventionally configured cutting elements. Less heating may prolong the useful lives of cutting tables 16 and the cutting elements 10 of which they are a part. Less heating may also impart a cutting element 10 of the present invention with a decreased rate of failure when compared with conventionally configured cutting elements. This may be particularly true when a cutting element 10 of the present invention is subjected to higher-than-normal temperature conditions, such as those present during geothermal drilling.

The reduced loading and friction, as well as the reduced build-up of cuttings on or adjacent to cutting elements 10, may also improve the drilling efficiency of an embodiment of a drill bit 200 of the present invention over drill bits that only include conventionally configured and oriented cutters. The improved drilling efficiency may enable an embodiment of drill bit 200 of the present invention to be placed under less WOB than a comparably configured drill bit that only includes conventionally configured cutters, while removing a comparable amount of material from an earth formation as, or even more material than, the comparably configured drill bit with conventional cutters. When an embodiment of a drill bit 200 of the present invention is subjected to less-than-conventional WOB, the likelihood that cutting elements 10 will be damaged during drilling is further reduced.

Although the foregoing description contains many specifics, these should not be construed as limiting the scope of the present invention, but merely as providing illustrations of some embodiments. Similarly, other embodiments of the invention may be devised which do not depart from the scope of the present invention. Features from different embodiments may be employed in combination. The scope of the invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed:

1. A cutting element for use with a rotary-type earth-boring drag bit, comprising:
- a substrate; and
- a cutting table disposed on the substrate, the cutting table having a face including:
  - a cutting region including a planar surface extending at a constant inward taper toward the substrate from an arcuate cutting edge at or adjacent to a peripheral edge of the cutting table to a borderline extending across the cutting table; and
  - a debris ejection region including a surface oriented at a constant outward taper from the borderline extending across the cutting table to a debris ejection location at or adjacent to the peripheral edge of the cutting table.

2. The cutting element of claim 1, wherein the arcuate cutting edge and the debris ejection location are located at diametrically opposite positions of the cutting table.

3. The cutting element of claim 1, wherein the debris ejection region of the cutting table is planar.

4. The cutting element of claim 1, wherein the borderline extends along a diameter of the cutting element.

5. A rotary-type earth-boring drag bit, comprising:
- a bit body with:
- a plurality of blades;
- junk slots between adjacent blades; and
- a plurality of cutting elements carried by each blade of the plurality of blades, at least one cutting element of the plurality including:
  - a cutting table secured to a substrate and comprising a face including:
    - a cutting region with a surface oriented at a constant positive rake angle relative to a formation to be cut and extending at a constant inward taper toward the substrate from an arcuate cutting edge at or adjacent to a peripheral edge of the cutting table to a borderline extending across the cutting table; and
    - a debris ejection region with a surface oriented at a constant outward taper from the borderline extending across the cutting table to a debris ejection location at or adjacent to the peripheral edge of the cutting table to direct cuttings from the formation toward an adjacent junk slot.

6. The rotary-type earth-boring drag bit of claim 5, further comprising:

at least one wear pad protruding from a surface of a blade of the plurality of blades at a location corresponding to the at least one cutting element.

7. The rotary-type earth-boring drag bit of claim 6, wherein the at least one wear pad protrudes a substantially uniform thickness from the surface of the blade across substantially an entire area of the at least one wear pad.

8. The rotary-type earth-boring drag bit of claim 6, wherein the at least one wear pad has a substantially planar surface.

9. The rotary-type earth-boring drag bit of claim 6, wherein substantially an entire area of the at least one wear pad is configured to wear at a substantially uniform rate.

10. The rotary-type earth-boring drag bit of claim 9, wherein the substantially uniform rate corresponds to a rate at which a cutting portion of the cutting table of the at least one cutting element wears.

11. A method for removing material from an earth formation, comprising:

engaging an earth formation with at least one cutting element carried by a bit body, the at least one cutting element including a cutting table secured to substrate, the cutting table having a face with a cutting portion including a surface oriented at a constant positive back rake angle and extending at a constant inward taper toward the substrate from an arcuate cutting edge at or adjacent to a peripheral edge of the cutting table to a borderline extending across the cutting table;

directing substantially all cuttings removed from the earth formation onto a debris ejection portion of the face of the cutting table comprising a surface oriented at a constant outward taper from the borderline extending across the cutting table to a debris ejection location at or adjacent to the peripheral edge of the cutting table; and directing the cuttings from the debris ejection portion of the face of the cutting table into a fluid course or junk slot.

12. The method of claim 11, wherein directing substantially all of the cuttings removed from the earth formation onto the debris ejection portion comprises causing substantially all of the cuttings to impact the debris ejection portion and to break up upon impacting the debris ejection portion.

13. The method of claim 11, further comprising:

carrying substantially all of the cuttings away from the bit body with drilling fluid flowing through the fluid course or junk slot.

14. The method of claim 11, further comprising:

limiting a depth of engaging an earth formation with at least one wear pad associated with the at least one cutting element.

* * * * *